US006463611B1

(12) United States Patent
Mattia et al.

(10) Patent No.: US 6,463,611 B1
(45) Date of Patent: Oct. 15, 2002

(54) APPARATUS FOR DISPENSING INCOMPATIBLE CHEMICALS TO A COMMON UTILIZATION POINT

(75) Inventors: Paul J. Mattia, Prior Lake; James L. Copeland, Apple Valley; Oliver Murphy, III, St. Paul; Kaye Kit-han Yuen, Minneapolis, all of MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/285,369

(22) Filed: Apr. 2, 1999

(51) Int. Cl.[7] ..... D06F 39/02

(52) U.S. Cl. ..... 8/158; 68/17 R; 68/207; 68/12.18; 134/57 R; 222/135; 222/255; 222/278

(58) Field of Search ..... 134/57 R; 68/17 R, 68/23.5, 207, 23.4, 23.6, 12.18; 222/255, 144.5, 129, 132, 135, 138, 252, 253, 254, 271, 274, 278, 283, 330, 331; 8/158; 366/138; 137/565

(56) References Cited

U.S. PATENT DOCUMENTS

| | | | | |
|---|---|---|---|---|
| 1,912,304 A | | 5/1933 | Phillips | |
| 2,314,152 A | | 3/1943 | Mallory | |
| 2,606,736 A | | 8/1952 | Ferm | |
| 2,641,271 A | | 6/1953 | Pressler | |
| 2,823,833 A | | 2/1958 | Bauerlein | |
| 3,044,285 A | * | 7/1962 | Koplin | 68/17 R |
| 3,160,317 A | | 12/1964 | Hambro | |
| 3,219,046 A | | 11/1965 | Waugh | |
| 3,229,077 A | | 1/1966 | Gross | |
| 3,336,767 A | | 8/1967 | Mackenzie et al. | |
| 3,444,242 A | | 5/1969 | Rue et al. | |
| 3,595,283 A | * | 7/1971 | Coenelius et al. | |
| 3,625,398 A | * | 12/1971 | Tometsko | |
| 3,645,421 A | * | 2/1972 | Tuthill | |
| 3,726,296 A | | 4/1973 | Friedland et al. | |
| 3,762,428 A | | 10/1973 | Beck et al. | |
| 3,764,041 A | * | 10/1973 | Noll | |
| 3,771,333 A | * | 11/1973 | Jurjans | 68/17 R |
| 3,797,744 A | | 3/1974 | Smith | |
| 3,804,297 A | * | 4/1974 | Jurjans | 68/17 R |
| 3,804,300 A | * | 4/1974 | Cox | |
| 3,826,113 A | * | 7/1974 | Boraas et al. | 68/207 |
| 3,891,123 A | * | 6/1975 | Blackburn | 68/207 |
| 4,020,865 A | | 5/1977 | Moffat et al. | |
| 4,090,475 A | | 5/1978 | Kwan | |

(List continued on next page.)

FOREIGN PATENT DOCUMENTS

| | | | |
|---|---|---|---|
| JP | 63-318997 | * 12/1988 | 68/17 R |

*Primary Examiner*—Frankie L. Stinson
(74) *Attorney, Agent, or Firm*—Merchant & Gould P.C.

(57) ABSTRACT

An apparatus that prevents an undesirable chemical reaction between different liquid chemical streams in a dispenser comprising a dispenser having a common manifold leading to a use locus. The common manifold has a pumping station directed to the common manifold and the pumping station has at least two chemical input lines. The dispenser is controlled by an electromechanical controller that prevents pumping two liquid chemical streams in sequence without an intervening water flush and prevents pumping two liquid chemical streams simultaneously. The liquid inputs to the pumping station are keyed such that the inputs can be connected only to containers that fit the keyed inputs.

17 Claims, 7 Drawing Sheets

U.S. PATENT DOCUMENTS 4,103,520 A 8/1978 Jarvis et al.
4,441,340 A 4/1984 Kaplan
4,524,801 A 6/1985 Magnasco et al.
4,526,188 A 7/1985 Olsson et al.
4,627,457 A 12/1986 Bird et al.
4,648,043 A 3/1987 O'Leary
4,691,850 A * 9/1987 Kirschmann et al.
4,696,326 A 9/1987 Sturgis
4,845,965 A 7/1989 Copeland et al.
4,848,381 A * 7/1989 Livingston et al. ..... 134/57 R
4,858,449 A 8/1989 Lehn
4,932,227 A 6/1990 Hogrefe
4,941,596 A 7/1990 Marty et al.
4,964,185 A 10/1990 Lehn
4,976,137 A 12/1990 Decker et al.
5,014,211 A 5/1991 Turner et al.
5,085,352 A 2/1992 Sasaki et al.
5,096,158 A 3/1992 Burdick et al.
D326,503 S 5/1992 Ipsen
D328,200 S 7/1992 Ipsen
5,139,182 A 8/1992 Appla
5,181,632 A 1/1993 Latter
5,195,203 A 3/1993 Blom et al.
5,203,366 A 4/1993 Czeck et al.
5,246,026 A 9/1993 Proudman
5,246,140 A 9/1993 Thix et al.
5,390,385 A 2/1995 Beldham
5,392,618 A 2/1995 Livingston et al.
5,435,157 A * 7/1995 Laughlin ..... 68/17 R
5,449,145 A 9/1995 Wortrich
5,507,419 A 4/1996 Martin et al.
5,564,595 A * 10/1996 Minissian ..... 68/17 R
5,597,021 A 1/1997 Crossdale et al.
5,597,093 A 1/1997 Lee
5,611,459 A 3/1997 Hinch
5,613,625 A * 3/1997 Specht
5,617,977 A 4/1997 Augustinus
5,632,420 A 5/1997 Lohrman et al.
5,636,762 A 6/1997 Juhola et al.
5,641,094 A 6/1997 Wunsch
5,647,416 A 7/1997 Desrosiers et al.
5,660,306 A 8/1997 Kim
5,678,737 A 10/1997 White
5,709,318 A 1/1998 Oder
5,711,355 A 1/1998 Kowalczyk
5,713,493 A 2/1998 Garibaldi
5,713,496 A 2/1998 Ipsen
5,725,132 A 3/1998 Foster et al.
5,746,238 A 5/1998 Brady et al.
5,971,019 A 10/1999 Imai
6,016,671 A * 1/2000 Beldham
6,055,831 A * 5/2000 Barbe

* cited by examiner

APPARATUS FOR DISPENSING INCOMPATIBLE CHEMICALS TO A COMMON UTILIZATION POINT

FIELD OF THE INVENTION

The invention relates to dispenser equipment specifically adapted for serially dispensing incompatible chemicals. Incompatible chemicals are defined as liquid chemicals that when mixed can result in creation of an undesirable reaction by-product. The dispenser combines safety features that ensure that the appropriate chemicals are attached to the appropriate input directed to a pumping station and that the dispenser cannot simultaneously dispense incompatible liquid streams and that after the pumping of a liquid stream is complete, the pump is not used again until the pump and manifold are flushed.

BACKGROUND OF THE INVENTION

Automatic dispensers that provide a liquid or fluid chemical solution to a use locus with little or no supervision have been common in the art. Such chemical dispensers are used in warewashing, laundry, hard surface cleaning, textile processing including the processing of thread and yarn, etc. Many such dispenser apparatus deliver chemical compositions to a use locus in a series of process treatment steps, wherein each treatment step requires a different kind of chemical. Such chemicals can include organic surfactants, nonionic rinse aids, acid compositions, alkaline compositions, chlorine bleach compositions, alkaline materials and a variety of other cleaning or treating materials. Often such materials have substantial functionality when used appropriately in a use locus, however, if mixed with another incompatible chemical, such a mixture can result in the production of an undesirable reaction by-product that can interfere either with the operation of the use locus, the operation of the dispenser or can interfere with or ruin the substrate present in the machine such as ware, laundry, textile or other materials. Further, some chemicals if mixed can be explosive or toxic. Mixing acid and a source of chlorine can result in the release of chlorine gas. Blending certain chemicals can also result in the release of hydrogen gas which can also have explosive consequences.

A number of such chemical systems are known in the art. For example, Kirschmann et al., U.S. Pat. No. 4,691,850, show a chemical dispensing system that involves liquid tote containers that are directly connected through tube-like inputs to a manifold for distribution to a use locus. Bird et al., U.S. Pat. No. 4,627,457, show a plurality of distribution manifolds connected to apparatus that can dilute product and distribute the product in an appropriate manifold. Copeland et al., U.S. Pat. No. 4,845,965, show a method to convert a solid product into a liquid concentrate for delivery to a use locus. Similarly, Lehn, U.S. Pat. No. 4,858,449, shows an apparatus that can provide a liquid concentrate from a solid block detergent dispensed from a dispenser unit. Turner et al., U.S. Pat. No. 5,014,211, show a dispenser apparatus controlled within an electronic controller that draws chemical from a source through a series of pumps, a single conduit, a selected locus from a set of use loci. Proudman, U.S. Pat. No. 5,246,026, similarly shows dispensing three or more liquid chemicals through dedicated pumps to a common dilution manifold under the direction of a system controller. Beldham, U.S. Pat. No. 5,390,385, shows an electronically controlled pumping system that can dispense a liquid chemical to a use locus under the control of a preprogrammed sequence. Lastly, Livingston et al., U.S. Pat. No. 5,392,618, dispenses chemicals from a drum source using individual pumps to separate manifolds directed to a use locus such as a laundry machine.

The prior art generally dispenses a liquid chemical from a source reservoir through a line to a pump which is then directed to either a common or a separate manifold that ends in a use locus. Connecting an inappropriate source of chemical to an incorrect line can result in contacting reactive liquids in the dispenser or use locus with the production of an undesirable reaction by-product that can be damaging or hazardous.

A substantial need exists for a dispenser apparatus that can prevent inappropriate contact between incompatible chemicals, thereby preventing the concomitant production of a harmful by-product. Such a dispenser will prevent the simultaneous dispensing of two incompatible chemicals, will prevent dispensing a liquid chemical through a manifold contaminated by an incompatible chemical and will prevent the inappropriate connection of a reservoir of a chemical to a manifold intended for an incompatible chemical. The prior art as a whole fails to provide such a dispensing device.

SUMMARY OF THE INVENTION

Accordingly, the invention is found in a dispenser apparatus that can provide two or more liquid chemical streams to a use locus, said chemical streams comprising incompatible streams such that upon mixing of the streams can result in the production of an undesirable reaction by-product in the mixed stream, the dispenser comprising a common manifold equipped with a fluid inlet, said manifold leading to an outlet connected to a container or use locus; a pumping station in liquid communication with the fluid inlet; at least two liquid inputs to the pumping station, each input having a coupling that can fit only a reservoir for an appropriate liquid chemical for that inlet; and an electromechanical controller that prevents the dispenser from pumping simultaneously different chemical streams to the manifold and also prevents pumping a liquid chemical into the manifold without an intermediate liquid or aqueous flush to remove residue of an incompatible liquid chemical. For the purposes of this disclosure the term incompatible chemical indicates a chemical, with reference to another chemical in a system, that produces an undesirable by-product, when mixed and as a result loses some substantial degree of function. Minor physical and chemical changes in the chemical that do not result in loss of function is not an indicia of incompatibility. Such incompatibility is shown in systems that form a precipitate that has no activity in the use locus; in systems that form a harmful gas such as chlorine ($Cl_2$), hydrogen ($H_2$), etc.; in systems that destroy the activity of a useful component such as a surfactant, an enzyme, a bleach, etc. or cause an undesirable phase separation in a chemical formulation. Such incompatibility results in a chemical or composition of the chemical that has reduced activity in a use locus. Conventional effects common in the use of chemicals in the use locus such as dissolution, dilution, ionization, mere color change without more, do not constitute chemical incompatibility.

DETAILED DISCUSSION OF THE INVENTION

Figure 1:
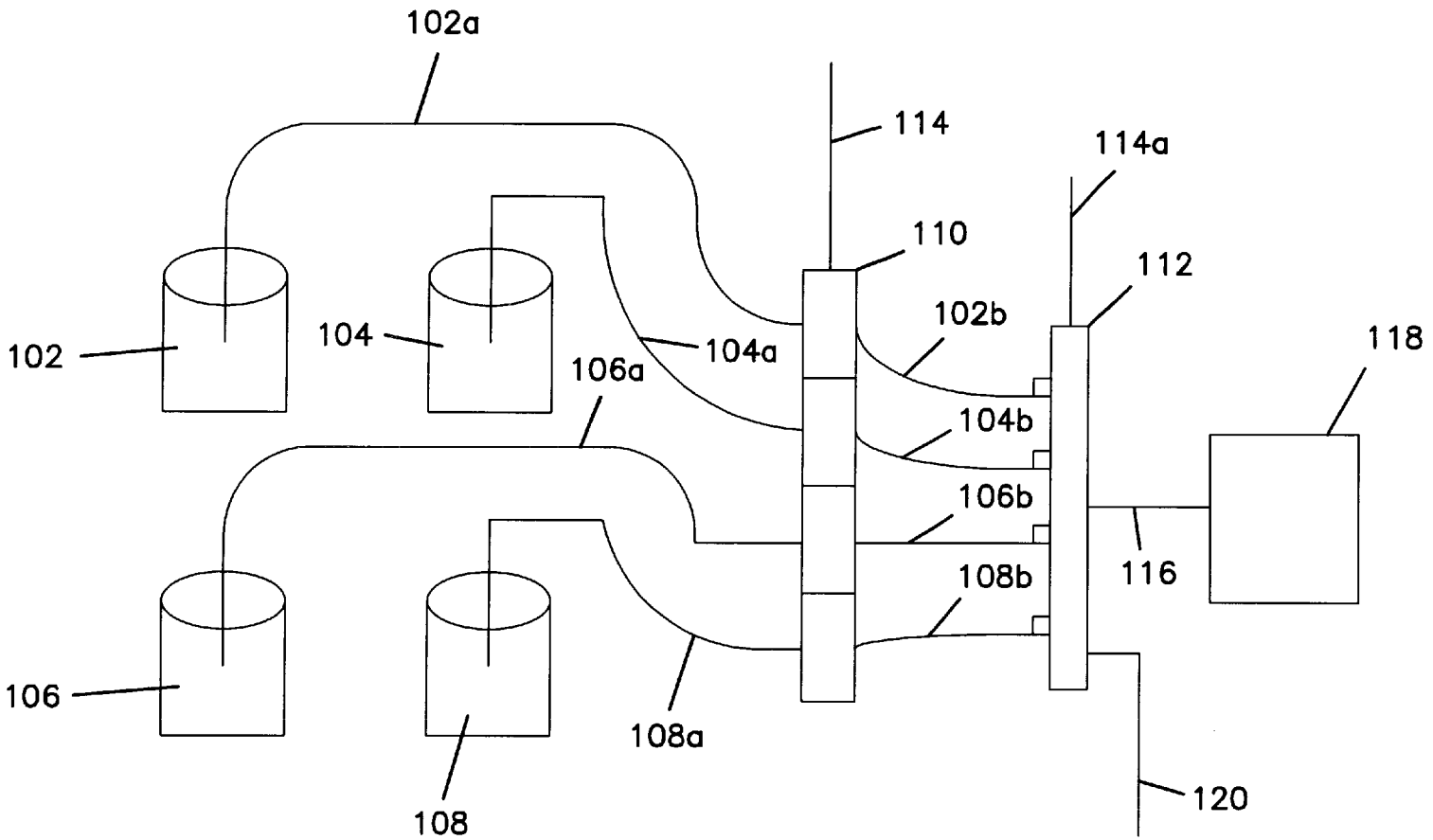
FIG. 1 is a schematic showing the overall plumbing scheme of the invention.

The dispenser of the invention can dispense two or more liquid chemical streams to a use locus such as a warewashing machine or laundry machine. The liquid chemicals are typically incompatible, in other words, contacting the incompatible chemicals can result in the production of an undesirable reaction by-product that can be harmful to the dispenser, harmful to the use locus, harmful to the substrate being treated in the use locus or harmful to personnel involved in the operation of the dispenser or use locus. In the assembly of the dispenser, the reservoirs for the liquid chemical are connected to a pumping station in the dispenser. The connectors that join the reservoirs to the input tubing or conduit of the dispenser leading to the pumping station are keyed such that the keyed input ends can be connected in liquid communication to the correct liquid reservoir. In other words, the hardware or (lock and key concept) place of connection between the input tubing and the reservoir has a unique coupling that will mate only with the appropriate reservoir. The tubing leads to a pumping station that can comprise a single pump or a pump dedicated to each fluid input. The pumps then lead to a common manifold which provides a conduit to the appropriate use locus. The dispenser is controlled with an electromechanical controller that selects the appropriate chemical for the appropriate stage of the treatment locus. The controller also ensures the appropriate operation of the dispenser such that when one liquid chemical is being dispensed, all other liquid chemicals are locked out of operation. Second, the controller operates the dispenser such that the manifold cannot be contacted with the liquid chemical unless a flush of the manifold occurs to remove all interfering amounts of a incompatible liquid chemical in the manifold. The preferred liquid chemical materials for use in the invention are aqueous liquid chemicals that are blended for commonly available warewashing and laundry equipment.

Chemicals Dispensed

The dispensed solutions can contain, for example, solid, powdered and liquid detergents; thickened aqueous detergent dispersions, viscous aqueous detergents, strippers, degreasers, souring agents, alkali meta-silicates, alkali metal hydroxides, sequestering agents, enzyme compositions (lipolytic, proteolytic, etc.), threshold agents, dye, optical brightener, nonionic surfactant, anionic surfactant, fragrance, alkali carbonates, iron control agents, defoamers, solvents, cosolvents, hydrotropes, rinse aids, bleach, and/or fabric softeners. More specifically, in a laundry environment, detergent, bleach, souring agent, bluing agent, and fabric softener can be utilized sequentially. The souring agent is generally incompatible with the other products (e.g., the detergent is alkaline, the souring agent is acidic and the bleach is typically sodium hypochlorite). The ingredients in other cleaning processes can also be incompatible. For example, changing the operable pH can occur or chemicals can react, thereby reducing or destroying cleaning properties.

Broad examples of incompatible chemicals include anions and cations which form insoluble precipitates upon contact. Another example includes reducing agents and oxidizing agents which can participate in oxidation-reduction, or redox, reactions.

There are a number of examples which could be given of pairs of mutually incompatible chemicals. A common example is one in which one liquid chemical comprises chlorine bleach and a second incompatible liquid chemical comprises an aqueous acid. Another example is one in which one liquid chemical comprises an acid chemical and a second incompatible liquid which comprises an aqueous alkaline material. A third common example is a situation in which a first liquid chemical comprises a chemical comprising an anion that when combined with a second incompatible liquid chemical comprising a cation results in the production of a relatively insoluble precipitate.

Various materials can be dispensed using the dispenser of the invention. These materials are water soluble ionic components from the group consisting of strong acids and strong bases, builder components, bleaches, and surfactants. While these materials may be compatible individually with other single materials, often the total composition contains at least one material which is incompatible with another in the composition. Basic groupings of incompatible chemicals include phosphates with alkalinity, chlorine with organics, chlorine in high ionic strength (highly alkaline) cleaners, and surfactants in highly alkaline cleaners. Preparation of unit doses (the amount required for an immediate cleaning task) immediately prior to use avoids problems often associated with such incompatibility.

The acids may be any acid generally used in any cleaning composition. Preferably, the acid used is either phosphoric acid, nitric acid, sulfuric acid or hydrochloric acid. More preferably, it is phosphoric, nitric or sulfuric acid.

The caustic used may be any caustic compound useful in cleaning compositions, preferably sodium or potassium hydroxide. These are commercially available as aqueous caustic solutions in typical concentrations such as 40–50%.

The builders contemplated by the invention include both phosphate and non-phosphate builder materials. Such materials and their uses are well known. For instance, the builders may be polyphosphates such as sodium tripolyphosphate, sodium hexametaphosphate or other complex polyphosphates. "Complex polyphosphate" means any phosphate with three or more phosphate groups or which forms complexes with metal ions to sequester them. The non-phosphate builders include NTA, EDTA, polyacrylates, copolymers, organic phosphonates and phosphinates.

The surfactants contemplated by the invention include both anionics and nonionics. Anionic surfactants or high foaming surfactants used in the invention include any surfactant which is high foaming surfactants. Numerous high foaming surfactants are known, e.g., sodium lauryl sulfate, alpha olefin sulfonate, sodium alkane sulfonate, linear alkane sulfonate and alkyl benzene sulfonate. Preferably, the anionic surfactant or high foaming surfactant, linear alkane sulfonate, a laurelate, or mixtures thereof.

Numerous nonionic surfactants can be used depending on the cleaning formulation desired and are well known to those skilled in the art. Such nonionic surfactants include PLURONIC™ L62, PLURONIC™ L64, Reverse PLURONICS™, alcohols, ethylene oxide-propylene oxide block copolymers, ethoxylates, etc. Nonionic surfactants are preferably ethylene oxide-propylene oxide [(EO) (PO)] block polymers or an ethylene oxide polymer of the formula $$R—(EO)_n—OCH_2—$$

wherein in R is alkyl, acyl, aryl, aliphatic or aromatic and are used with caustic solutions and n is an integer from about 8 to 24. More preferably, the nonionic surfactant is an ethylene oxide polymer of the formula:

$$R—(EO)_n—OCH_2—$$

wherein R is alkyl, acyl, aryl, aliphatic or aromatic and n is about 12.

The bleaches contemplated by the invention may be hypochlorite, peroxy or oxygen bleaching materials. Preferably they are hypochlorite (HClO) based bleaches, and most preferably, sodium hypochlorite. Typical concentrations include aqueous 5–15% sodium hypochlorite.

Use Locus

While the dispenser of the invention could be used in a variety of use locales, it is preferred that the use locus comprises one or more laundry machines. For example, the use locus could comprise a tunnel washer.

Electromechanical Control

Figure 9:
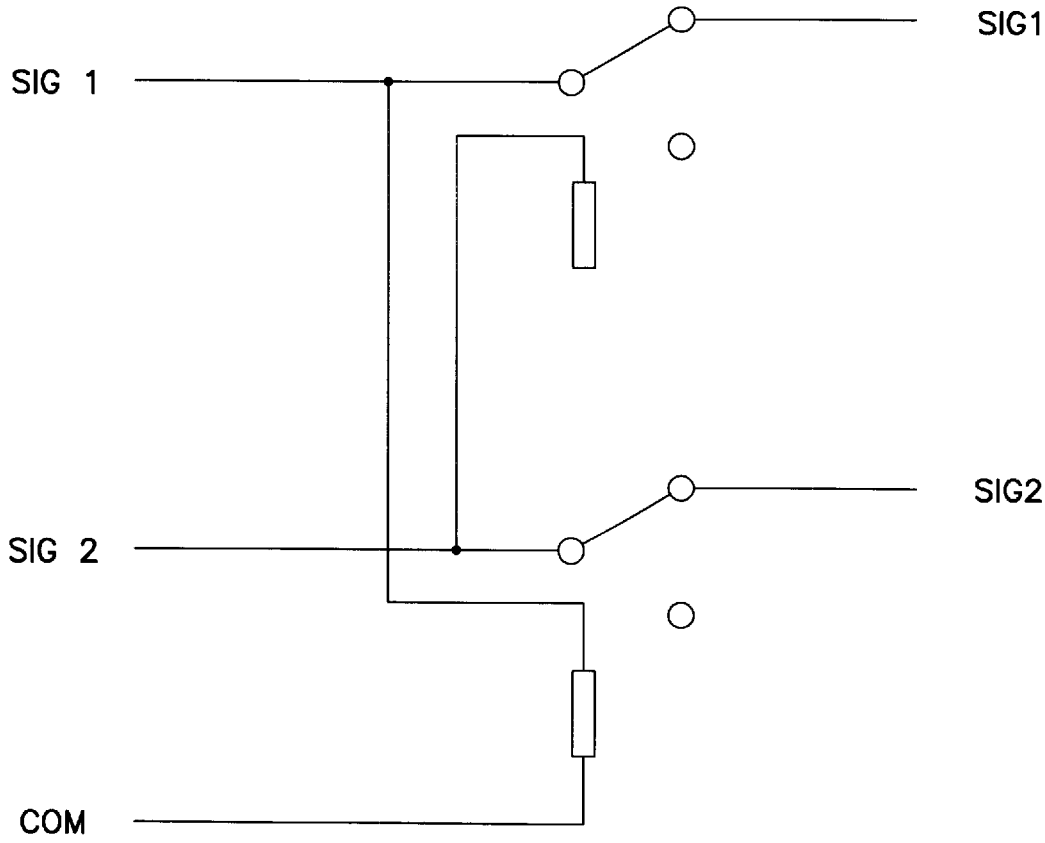
FIG. 9 is a schematic showing an embodiment of the circuitry used to create an exclusive OR gate as used in the dispenser of the invention.

FIG. 9 shows a schematic of a circuit which functions as an exclusive OR gate. The circuit uses a plurality of relays. Essentially, this gate prevents simultaneous dispensation of two streams. The signal created by dispensation of one stream prevents dispensation of a second stream until after the first stream has ceased and a rinsing step has occurred. This not only prevents simultaneous dispensation of two incompatible streams, it also prevents a second stream from reacting with residue remaining from a previous stream.

Plumbing and Pumps

The pumping station is in fluid communication with both the manifold and a plurality of individual chemical reservoirs. While a single pump can be used for multiple chemical streams, it is preferred that the pump station comprises a pump for each liquid input. While this represents an increase in expense, it simplifies the plumbing arrangements substantially by reducing the number of controllable valves needed. Suitable pumps can include gear pumps, air diaphragm pumps, peristaltic pumps and others. Preferably, the pumping station comprises a plurality of peristaltic pumps.

Connectors

The dispenser of the invention includes a plurality of couplings wherein each coupling is attached to a particular liquid input and can fit only a reservoir for an appropriate liquid chemical for that inlet. To accomplish this, each coupling comprises a pair of mutually compatible geometric lockouts parts A and B. Part A, or the probe, is the male part of the coupling, whereas part B, the bung cup, is the female part of the coupling. The lockout comprises of a pair of indentations on part A and a pair of matching protrusions on part B. These indentations and protrusions can be rotated around the vertical axis, thereby providing multiple lockouts. Preferably, the indentations and protrusions are rotated around the vertical axis at 30° intervals. Preferably, each indentation and each protrusion are 180° opposed to the other indentation and protrusion, respectively.

Detailed Description of the Figures

FIG. 1 shows generally a schematic 100 of the dispenser of the invention in use. This particular schematic shows the use of four distinct chemical reservoirs, but the invention is not limited to this. The invention is useful with as few as two distinct chemical streams, and with as many streams as could possibly be needed at a single use locus. Seen in this Figure are chemical reservoirs 102, 104, 106 and 108, which could be of virtually any size, ranging from small concentrate containers to large containers such as 55 gallon drums. Each reservoir 102, 104, 106 and 108 is connected via inlet lines 102*a*, 104*a*, 106*a* and 108*a* to pumping station 110, which is shown in greater detail in FIG. 2. Not seen in this Figure are the unique couplings between each reservoir 102, 104, 106 and 108 and each inlet line 102*a*, 104*a*, 106*a* and 108*a*. These couplings are instead shown in detail in FIGS. 4–6. Also seen entering pumping station 110 is water line 114, which serves to provide water for the flushing step which takes place after each chemical is dispensed.

Shown exiting pumping station 110 are outlet lines 102*b*, 104*b*, 106*b* and 108*b*. The particular embodiment shown assumes a pumping station 110 which comprises a separate pump for each chemical. If, however, a single pump was used for all chemicals, only a single outlet line (not seen) would be needed. The outlet line (or lines 102*b*, 104*b*, 106*b* and 108*b*) pass from pumping station 110 to manifold 112, where each chemical in turn is diluted by incoming water stream 114*a*. Alternatively, if dilution was not desired, an air push (not shown) could be used in place of water stream 114*a*. Two streams 116 and 120 exit manifold 112. Stream 116 carries the desired diluted chemical to use locus 118 while stream 120 carries dirtied flushing water away to waste (not shown). As described above, use locus 118 preferably comprises one or more laundry machines.

Figure 2:
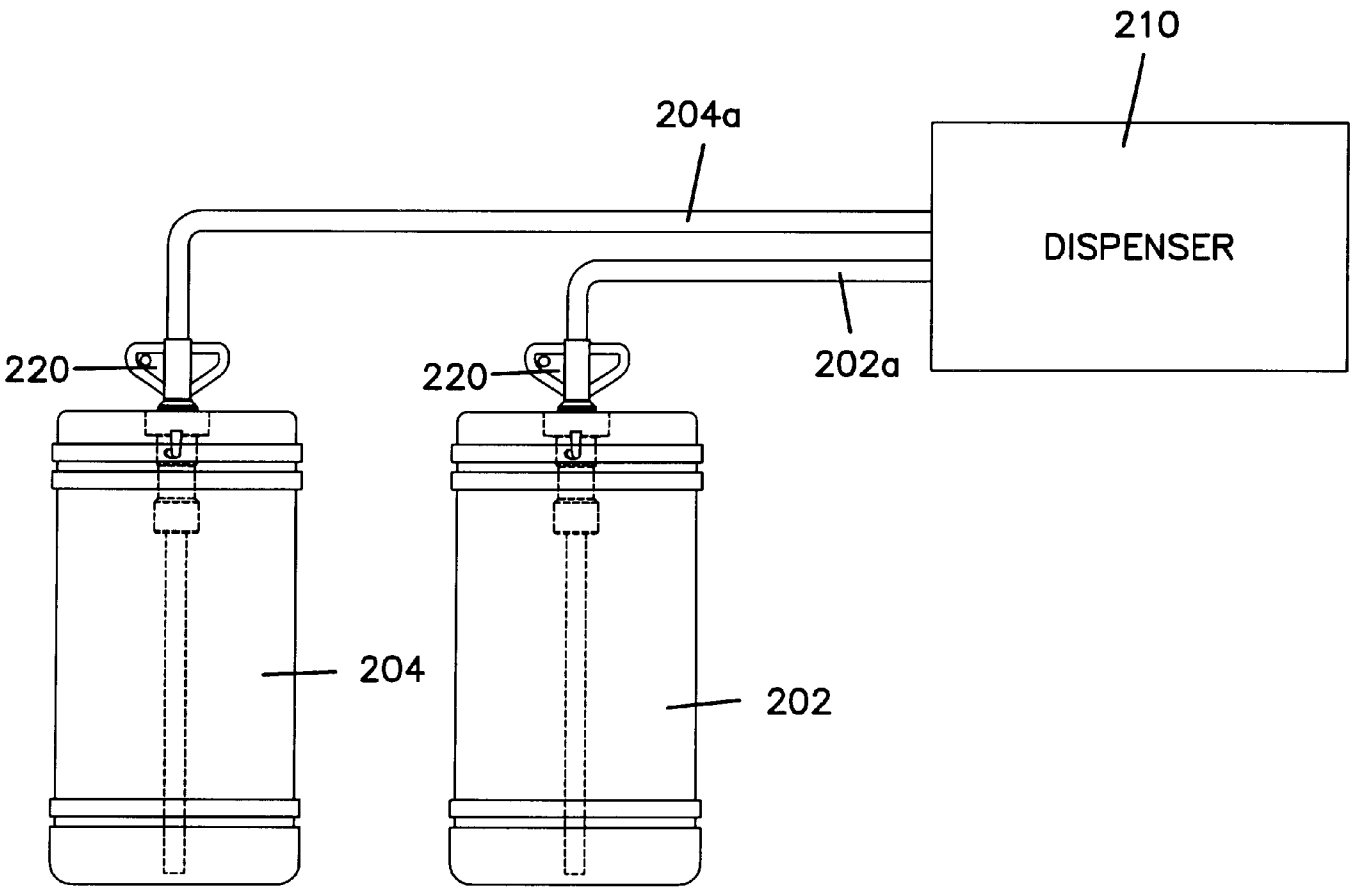
FIG. 2 shows an embodiment in which two liquid chemical supply barrels are attached to the dispenser of the invention.

FIG. 2 shows a particular embodiment of the invention in which two sources of liquid chemicals are seen operatively attached to the dispenser of the invention. In this Figure, dispenser 210 is shown in black box fashion. Actually, the dispenser comprises pumping station 110 and manifold 112 seen in FIG. 1.

In this Figure, incompatible liquid chemicals of distinct identification are present in barrels 202 and 204. Couplers 220 are seen generally here, but are described in greater detail in subsequent Figures. Each barrel 202 and 204 is seen to have its own coupler 220 attached to supply lines 202*a* and 204*a*, respectively. The Figure is shown with only two chemical supplies for ease of illustration only. The dispenser of the invention can also be used with a substantially greater number of distinct chemicals.

Figure 3:
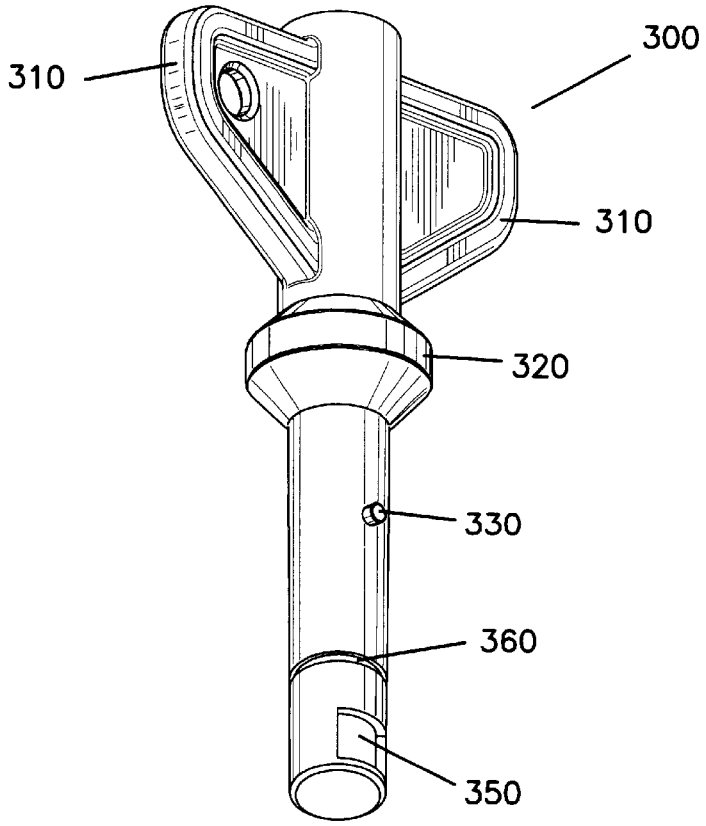
FIG. 3 is a schematic of the inner probe portion of the coupling used in the invention.

FIG. 3 shows inner probe 300 which comprises a portion of the coupler used in the invention. Inner probe 300 is seen as having wings 310 for ease of use, and to provide additional gripping and torque generating surface. Slider pegs 330 (only one seen) serves to moveably locate said inner probe 300 within an unseen outer probe. An O-ring groove 360 holds an unseen O-ring while windows 350 (only one seen) permits liquid to flow through.

Figure 4:
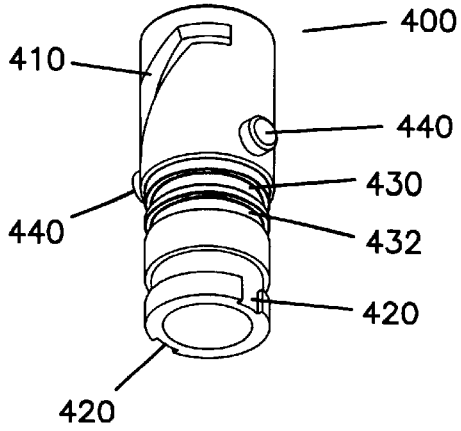
FIG. 4 is a schematic of the outer probe portion of the coupling used in the invention.

FIG. 4 shows outer probe 400. The outer probe 400 includes a slider track 410 which serve to movably locate said outer probe 400 on the inner probe 300. Locking pegs 440 and indentations 420 serve to help provide the necessary lockout geometry, as described later. The outer probe 400 also has a pair of O-ring grooves 430 and 432, respectively, which hold O-rings to seal against leaks.

Figure 5:
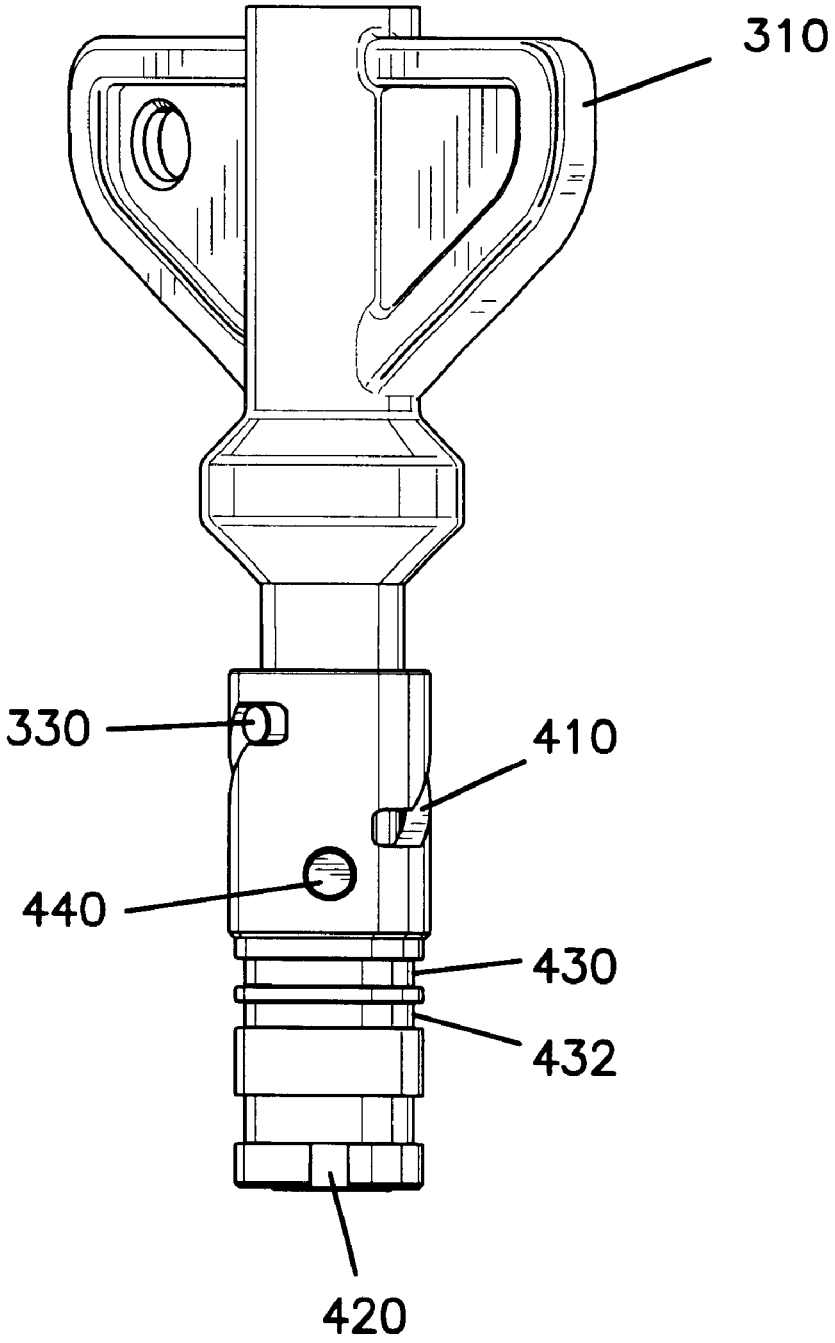
FIG. 5 is a schematic showing a combined inner probe and outer probe, which is seen in a fully closed position.

FIG. 5 shows a combined inner probe 300 and outer probe 400. In this view, the probe is seen in its fully closed position. As before, slider pegs 330 serve to moveably locate the inner probe 300 via slider tracks 410 within the outer probe 400. Also visible in this view are O-ring grooves 430 and 432. An important aspect of this Figure concerns the relationship between locking pegs 440 and indentations 420 (only one seen). In this particular drawing, these are shown in axial alignment with one another. It is this relationship, in cooperation with the placement of locking grooves and protrusions present in the bung cup, which provides the unique geometric lockout feature of the couplers used in the dispenser of the invention. The indentations 420 can be moved radially about the outer probe 400 to provide additional lockout geometries. Preferably, the indentations are located radially at multiples of 30° from the lockout pegs 440.

Figure 6:
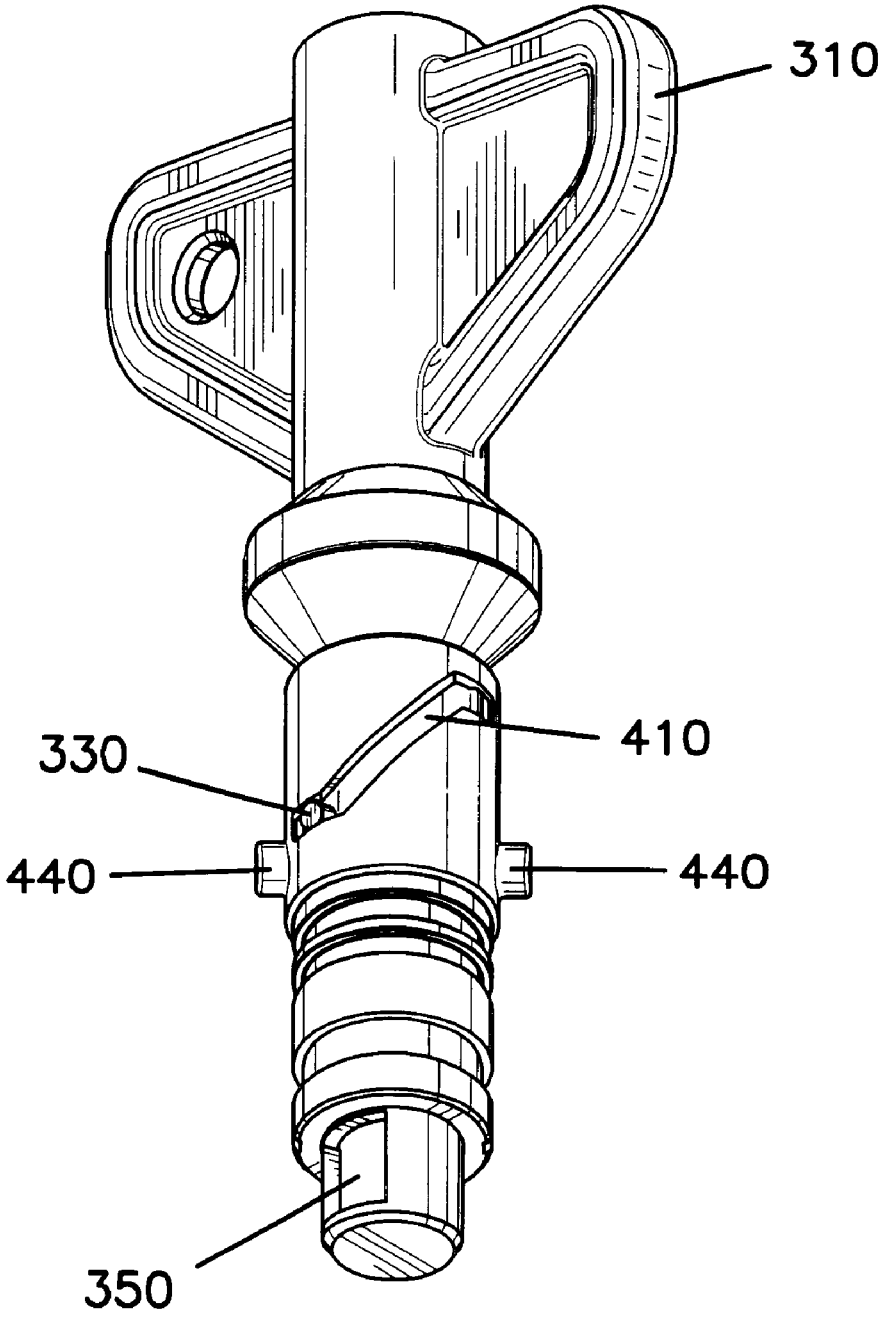
FIG. 6 is a schematic showing a combined inner probe and outer probe, which is seen in a fully open position.

FIG. 6 is similar to FIG. 5, but shows the combined probe in a fully open position. In this drawing, inner probe 300 has been rotated downward into outer probe 400. This can be seen as slider peg 330 has moved downward in slider track 410. In this position, windows 350 are opened, which will allow fluid to flow through the combined probe when fully inserted into an appropriate bung cup.

The male portion of the coupler comprises two parts: an inner probe 300 and an outer probe 400. The two parts are made of thermoplastic material, but can also be made out of metal, using a die cast system. Preferably, the inner and outer probes are constructed from glass filled polypropylene. The assemblies of the two parts come together to function as a probe that can be open and shut to allow product to flow through.

The inner probe is constructed with two assembly pegs 330, an O-ring groove 360 and two windows 350 (only one seen). Slider pegs 330 are snapped into slider track 410 of the outer probe 400. Windows 350 allow fluid to flow through when the probe is opened. The O-ring groove 360 is for an O-ring to create a tight seal between the inner probe 300 and outer probe 400. The outer probe 400 is constructed with a slider track 410, locking pins 440, two O-ring grooves 430 and 432, and a pair of indentations 420. Slider track 410 guides inner probe 300 to protrude a certain distance to open the windows 350 to allow product to flow through. Locking pegs 440 lock the combined probe into place during use. For assembly, an O-ring is placed on the inner probe 300; the outer probe 400 is placed over the inner probe 300, snapping the slider pegs 330 into the slider track 410. A spring (not shown) may be used between the two parts to facilitate the opening and closing of the combined probe.

Figure 7:
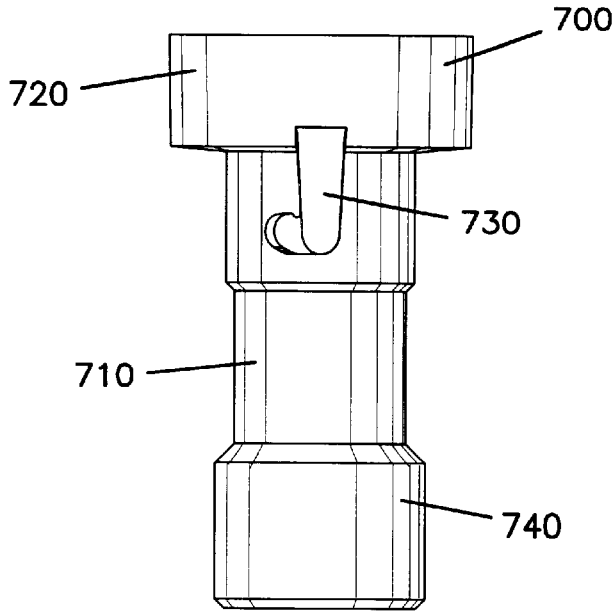
FIG. 7 is a schematic of the bung cup which is complementary to the coupling used in the invention; specifically, the combined inner and outer probes.

FIG. 7 shows the bung cup 700, which is typically mounted in the top of a barrel or other container which holds a liquid chemical which can be dispensed by the dispenser of the invention. Typically, the bung cup 700 could be adhered to a drum bung (not seen) for ease of use. Drum bungs are often threaded for simple installation in a drum or other chemical containing container. The bung cup 700 can be glued to the drum bung, or could be attached via sonic welding.

Seen is a tubular body 710 and enlarged upper portion 720, which serves to accept the male portion of the coupler, comprising inner probe 300 and outer probe 400. Locking tracks 730 (only one seen in this view) serve to accept the locking pegs 440 present on the outer probe 400. Lower portion 740 is sized to accept an appropriately sized dip tube. Preferably, lower portion 740 is threaded on the inner surface to facilitate a friction fit with a dip tube. However, the dip tube could also be secured by an appropriate adhesive. The size of the dip tube can be determined by the flow rates necessary.

Figure 8:
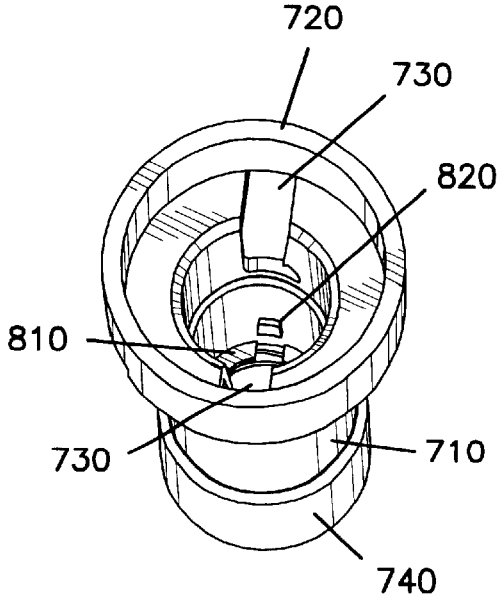
FIG. 8 is a perspective view of the bung cup of FIG. 7, showing part of the lockout geometry present in the bung cup.

FIG. 8 is a perspective view which shows a portion of the interior of the bung cup 700 having an upper portion 720, tubular body 710 and lower portion 740. The important features of this Figure include protrusions 820 (only one seen) and their geometric relationship with the locking grooves 730, which accept locking pegs 440.

To operate, the combined probe slides into bung cup 700, using locking pins 440 and bung cup locking groove 730 for guidance. The combined probe slides pass the lockout protrusions 820, and is turned clockwise until it cannot turn anymore. As the combined probe is turned, inner probe 300 slides down sliding track 410 along slider pegs 330 and exposes windows 350. Once windows 350 are exposed, the latter part of the turn locks the probe into place. The latter part of the turn also moves indentations 420 downward beyond the protrusions 820, thereby sealing the probe to the bung cup.

FIG. 9 shows a schematic a circuit which functions as an exclusive OR gate. This exclusive OR gate only permits one chemical to be dispensed, as one signal locks the other one out. In the diagram, "Sig 1" represents a command from a washer, requesting dispensing of a chemical. "Sig 2" represents the signal sent from the control mechanism to the dispenser. When "Sig1" is received by the circuit, "Sig2" is sent to the dispenser and the desired chemical is dispensed. At the same time, however, any signals received which request dispensation of other chemicals are blocked out. No other signals are accepted until after a rinsing step has occurred.

Various products may be mixed using this process. Categories of compositions contemplated by the invention include polyphosphates in high pH solutions, chlorine with organics in solution, chlorine at high ionic strengths and physically incompatible or multi-phase compositions. The uses described below are those recognized by those skilled in the art.

Warewashing detergents that typically comprise a major proportion of a strongly alkaline material such as sodium hydroxide, sodium carbonate, sodium silicate can be combined with a sequestrant such as sodium tripolyphosphate, NTA, EDTA or other suitable chelating agents. The alkaline materials can be blended with defoaming agents, minor amounts of nonionic surfactants, peptizing agents, etc. Such warewashing agents typically rely on the cleaning capacity of the largely inorganic formulations for activity.

Laundry detergents typically comprise a relatively large amount of a nonionic or anionic surfactant material in combination with the alkaline source or builder. Laundry detergents also contain a variety of other materials including brighteners, antiredeposition agents, softeners, enzymes, perfumes, dyes, etc.

Clean-In-Place (CIP) system cleaners are used to clean plant equipment, and they may be produced using nonionic surfactants, builders, bleach components and caustic components. These materials are delivered to the filling station where they are diluted by adding a predetermined amount of water. The cleaning solution is then transported to the use point in a small container, and the surfaces to be cleaned are dosed with the cleaning solution.

Boil-out compositions may also be produced through this process. Boil-out compositions are used to remove soils and built up scale from process equipment. In these compositions a caustic solution containing sodium gluconate and a surfactant are incorporated into the boil-out composition. A bleach may also be incorporated. While generally the caustic and bleach components are incompatible at levels above about 15% caustic, i.e., loss of available chlorine over five days becomes appreciable in solutions above about 15% caustic, the short storage periods made possible by the invention allow these incompatible materials to be used. Additionally, since the cleaning solution is produced as a unit dose, there are no detrimental fluctuations in cleaning concentrations at the use point. Additionally, an acid cleaning solution may be used after the boil-out composition to fully remove any films which may result from, e.g., the use of hard water, greater than 100 ppm, and dissolved compounds.

Acid cleaning compositions may be needed in both CIP and boil-out compound compositions. These are required where the hardness of the water is such that there are over 100 parts per million dissolved heavy metal ions in the water. These acids are generally used to dissolve a calcium carbonate or other film remaining on the equipment after the traditional CIP caustic or boil-out compound dosing.

Chlorinated foaming cleaners can also be produced by our process. Again, a caustic component, bleach component, builder component, and surfactant are delivered to the filling station at which point they are diluted. The caustic component may be sodium hydroxide, the builder may be phosphate or non-phosphate, and the surfactant may be foaming surfactants.

Finally, the cleaning products can be tailored to the hardness and pH of the service water at the use plant. Thus, cleaning compositions can be developed for use in hard, medium or soft water environments. The compositions used in the examples are shown in Table I below.

TABLE I

| Ingredient | Description |
|---|---|
| Anionic Surfactant | 75% (sodium salt of) dodecyl benzene sulfonic acid<br>25% sodium xylene sulfonate (40%) |
| Phosphate Builder | 29% sodium hexametaphosphate<br>71% water |
| Non-Phosphate Builder | 50% acrylic/itaconic copolymer (50%)<br>28% sodium hydroxide (50%)<br>22% water |
| Chlorine Source | sodium hypochlorite (9.5%) |
| Caustic | 95.8 sodium hydroxide (50%)<br>4.2% Sodium Gluconate |
| Nonionic Surfactant | 85% ethoxylated alcohol (U.S. Pat. No. 3,444,242)<br>15% water |

EXAMPLE 1

CIP cleaners are made for varing supply water hardnesss according to the proportions indicated in Table II. Phosphate stability data are illustrated in Tables VII, VIII, and IX, and chlorine stability data are illustrated below in Table X. Formulas 1, 4, 7, and 10 are used with soft service water; Formulas 2, 5, 8, and 11 are 35 are used with medium service water, and Formulas 3, 6, 9, and 12 are used with hard service water.

TABLE II

CIP Cleaning Composition

| | FORMULA | | | | | | | | | | | |
|---|---|---|---|---|---|---|---|---|---|---|---|---|
| INGREDIENT | 1 | 2 | 3 | 4 | 5 | 6 | 7 | 8 | 9 | 10 | 11 | 12 |
| Anionic Surfactant | | | | | | | | | | | | |
| Phosphate Builder | 2.6 | 12.0 | 20.0 | 2.6 | 12.0 | 20.0 | 2.6 | 12.0 | 20.0 | 2.6 | 12.0 | 20.0 |
| Non-Phosphate Builder | | | | | | | | | | | | |
| Chlorine Source | | | | | | | 30.0 | 30.0 | 30.0 | 30.0 | 30.0 | 30.0 |
| Caustic | 32.5 | 32.5 | 32.5 | 32.5 | 32.5 | 32.5 | 32.5 | 32.5 | 32.5 | 32.5 | 32.5 | 32.5 |
| Nonionic Surfactant | 1.3 | 1.3 | 1.3 | | | | | | | 1.3 | 1.3 | 1.3 |
| Water | 64.9 | 55.5 | 42.5 | 63.6 | 54.2 | 46.2 | 34.9 | 25.5 | 17.5 | 33.6 | 24.2 | 16.2 |

EXAMPLE 2

Chlorinated foaming cleaning compositions are made according to the proportions indicated in Table III. Phosphate stability data illustrated below in Tables VII, VIII and IX and chlorine stability data are illustrated below in Table X.

TABLE III

| | FORMULA | | | | | | | |
|---|---|---|---|---|---|---|---|---|
| INGREDIENT | 13 | 14 | 15 | 16 | 17 | 18 | 19 | 20 |
| Anionic Surfactant | 11.4 | 11.4 | 11.4 | 11.4 | 6.0 | 6.0 | 6.0 | 6.0 |
| Phosphate | | | 27.6 | 27.6 | | | 27.6 | 27.6 |

TABLE III-continued

| | FORMULA | | | | | | | |
|---|---|---|---|---|---|---|---|---|
| INGREDIENT | 13 | 14 | 15 | 16 | 17 | 18 | 19 | 20 |
| Builder | | | | | | | | |
| Non-Phosphate Builder | | | | | | | | |
| Chlorine Source | 19.2 | 19.2 | 19.2 | 19.2 | 19.2 | 19.2 | 19.2 | 19.2 |
| Caustic | 8.4 | 16.9 | 8.4 | 16.9 | 8.4 | 16.9 | 8.4 | 16.9 |
| Nonionic Surfactant | | | | | | | | |
| Water | 61.0 | 52.5 | 33.4 | 24.9 | 66.4 | 57.9 | 38.9 | 30.3 |

EXAMPLE 3

Boil-out compositions are made according to the proportions indicated in Table IV.

TABLE IV

Boil-out Compositions

| | FORMULA | | |
|---|---|---|---|
| Ingredient | 21 | 22 | 23 |
| Anionic Surfactant | | | |
| Phosphate Builder | | | |
| Non-Phosphate Builder | | | |
| Chlorine Source | 6.5 | | 6.5 |
| Caustic | 90.0 | 95.5 | 89.0 |

TABLE IV-continued

Boil-out Compositions

| | FORMULA | | |
|---|---|---|---|
| Ingredient | 21 | 22 | 23 |
| Nonionic Surfactant | | 1.0 | 1.0 |
| Water | 3.5 | 3.5 | 3.5 |

EXAMPLE 4

Non-phosphate CIP cleaning compositions are made according to the proportions indicated in Table V.

| INGREDIENT | 24 | 25 | 26 | 27 | 28 | 29 | 30 | 31 | 32 | 33 | 34 | 35 |
|---|---|---|---|---|---|---|---|---|---|---|---|---|
| Anionic Surfactant | | | | | | | | | | | | |
| Phosphate Builder | | | | | | | | | | | | |
| Non-Phosphate Builder | 2.6 | 7.7 | 12.8 | 2.6 | 7.7 | 12.8 | 2.6 | 7.7 | 12.8 | 2.6 | 7.7 | 12.8 |
| Chlorine Source | | | | 30.0 | 30.0 | 30.0 | | | | 30.0 | 30.0 | 30.0 |
| Caustic | 32.5 | 32.5 | 32.5 | 32.5 | 32.5 | 32.5 | 32.5 | 32.5 | 32.5 | 32.5 | 32.5 | 32.5 |
| Nonionic Surfactant | | | | | | | 1.3 | 1.3 | 1.3 | 1.3 | 1.3 | 1.3 |
| Water | 64.9 | 59.8 | 54.7 | 34.9 | 29.8 | 24.7 | 63.6 | 58.5 | 53.4 | 33.6 | 28.5 | 23.4 |

EXAMPLE 5

Non-phosphate chlorinated foaming cleaning compositions are made according to the proportions indicated in Table VI.

TABLE VI

Non-Phosphate Chlorinated Foaming Cleaning Compositions

| | FORMULA | | | |
|---|---|---|---|---|
| Ingredient | 36 | 37 | 38 | 39 |
| Anionic Surfactant | 11.4 | 11.4 | 6.0 | 6.0 |
| Phosphate Builder | | | | |
| Non-Phosphate Builder | 19.1 | 19.1 | 19.1 | 19.1 |
| Chlorine Source | 19.2 | 19.2 | 19.2 | 19.2 |
| Caustic | 8.4 | 16.9 | 8.4 | 16.9 |
| Nonionic Surfactant | | | | |
| Water | 41.9 | 33.4 | 47.3 | 38.8 |

The foregoing description, examples and data are illustrative of the invention described herein, and they should not be used to unduly limit the scope of the invention or the claims. Since many embodiments and variations can be made while remaining within the spirit and scope of the invention, the invention resides wholly in the claims hereinafter appended.

We claim:

1. A dispenser apparatus that can provide two or more liquid chemical streams to a use locus, said chemical streams comprising incompatible streams such that upon mixing of the streams can result in the production of an undesirable reaction by-product, the dispenser comprising:

(a) a common manifold equipped with a fluid inlet, said manifold leading to an outlet connected to a use locus;

(b) a pumping station in liquid communication with the fluid inlet;

(c) at least two liquid inputs to the pumping station, wherein:

(i) the at least two liquid inputs each comprise a coupling that can fit only a reservoir for an appropriate liquid chemical for that liquid input;

(ii) each coupling comprising an inner probe and an outer probe, wherein the inner probe and the outer probe are constructed to rotate relative to each other; and (d) an electromechanical controller that prevents the dispenser from simultaneously pumping different chemical streams to the manifold and prevents pumping a liquid chemical into the manifold without an intermediate liquid flush to remove residue of an incompatible liquid chemical.

2. The dispenser of claim 1 wherein the pump station comprises a pump for each liquid input.

3. The dispenser of claim 1 wherein the pump station comprises a valve for each liquid input.

4. The dispenser of claim 1 wherein the liquid chemical comprises an aqueous liquid chemical.

5. The dispenser of claim 4 wherein the aqueous liquid chemical comprises a major proportion of water and a minor proportion of a compatible solvent.

6. The dispenser of claim 1 wherein the use locus comprises one or more laundry machines.

7. The dispenser of claim 6 wherein the laundry machine comprises a tunnel washer.

8. The dispenser of claim 1 wherein one liquid chemical comprises chlorine bleach and a second incompatible liquid chemical comprises an aqueous acid.

9. The dispenser of claim 1 wherein one liquid chemical comprises an acid chemical and a second incompatible liquid comprises an aqueous alkaline material.

10. The dispenser of claim 1 wherein a first liquid chemical comprises a chemical comprising an anion that when combined with a second incompatible liquid chemical comprising a cation results in the production of a relatively insoluble precipitate.

11. The dispenser of claim 1 wherein a first liquid chemical comprises a chemical comprising an electron donor and a second liquid chemical comprises a chemical comprising an electron acceptor.

12. A method of dispensing two or more liquid chemical streams to a use locus, said chemical streams comprising incompatible streams such that upon mixing of the streams can result in the production of an undesirable reaction by-product, the method comprising dispensing a first chemical stream from a pumping station in liquid communication with the fluid inlet, the pumping station comprising at least two liquid inputs to the pumping station, each input having a coupling that can fit only a reservoir for an appropriate liquid chemical for that inlet; said chemical stream dispensed into to a common manifold equipped with a fluid inlet, said manifold leading to an outlet connected to a use locus, wherein an electromechanical controller prevents both the simultaneous dispensing of a second and different chemical streams to the manifold and requires an intermediate liquid flush to remove residue of the first chemical stream before dispensing a second chemical stream.

13. A dispenser apparatus that can provide two or more liquid chemical streams to a use locus, the dispenser apparatus comprising:

(a) a manifold in fluid communication with at least two inlet lines, wherein each inlet line is constructed for attachment to a separate container containing an appropriate liquid chemical for that inlet line;

(b) at least two chemical containers, each chemical container comprising an opening and a bung cup provided in the opening; and (c) at least two couplings, each coupling connecting the at least two inlet lines to the at least two chemical containers, each coupling is constructed to fit within one of the bung cups, each coupling comprising an inner probe and an outer probe, wherein the inner probe and the outer probe are constructed to rotate relative to each other.

14. A dispenser apparatus according to claim 13, further comprising:

(a) an exit stream from the manifold to a use locus.

15. A dispenser apparatus according to claim 13, wherein the manifold further comprises a water inlet and a dirtied flushing water outlet.

16. A dispenser apparatus according to claim 13, further comprising:

(a) a pumping station provided between the manifold and the couplings for directing liquid chemical from the liquid chemical containers to the manifold.

17. A dispenser apparatus according to claim 16, wherein the pumping station comprises a water inlet.

* * * * *

UNITED STATES PATENT AND TRADEMARK OFFICE

CERTIFICATE OF CORRECTION

PATENT NO. : 6,463,611 B1
DATED : October 15, 2002
INVENTOR(S) : Mattia et al.

It is certified that error appears in the above-identified patent and that said Letters Patent is hereby corrected as shown below:

Title page,
Item [56], References Cited, FOREIGN PATENT DOCUMENTS, insert
-- EP 0 403 296 B1 * 12/1990 --

Column 9,
Line 32, Example 1: "35 are" should be deleted
Line 56, Example 2: "data illustrated" should read -- data are illustrated --

Column 12,
Line 48, "into to a" should read -- into a --

Signed and Sealed this

Eighteenth Day of March, 2003

JAMES E. ROGAN
*Director of the United States Patent and Trademark Office*